US005608944A

United States Patent [19]

Gordon

[11] Patent Number: 5,608,944

[45] Date of Patent: Mar. 11, 1997

[54] VACUUM CLEANER WITH DIRT DETECTION

[75] Inventor: Evan A. Gordon, North Canton, Ohio

[73] Assignee: The Hoover Company, North Canton, Ohio

[21] Appl. No.: 461,151

[22] Filed: Jun. 5, 1995

[51] Int. Cl.[6] ..... A47L 9/28

[52] U.S. Cl. ..... 15/319; 15/339

[58] Field of Search ..... 15/319, 339, 326

[56] References Cited

U.S. PATENT DOCUMENTS

| | | | |
|---|---|---|---|
| 1,565,382 | 12/1925 | McClatchie . | |
| 3,674,316 | 7/1972 | DeBrey | 302/65 |
| 3,989,311 | 11/1976 | Debrey | 302/65 |
| 4,099,861 | 7/1978 | Abel | 355/15 |
| 4,175,892 | 11/1979 | Debrey | 406/35 |
| 4,580,311 | 4/1986 | Kurz | 15/319 |
| 4,601,082 | 7/1986 | Kurz | 15/319 |
| 4,767,213 | 8/1988 | Hummel | 356/338 |
| 4,829,626 | 5/1989 | Harkonen et al. | 15/319 X |
| 5,136,750 | 8/1992 | Takashima et al. | 15/319 |
| 5,163,202 | 11/1992 | Kawakami et al. | 15/319 |
| 5,319,827 | 6/1994 | Yang | 15/319 |
| 5,502,869 | 4/1996 | Smith et al. | 15/326 |

FOREIGN PATENT DOCUMENTS

| | | | |
|---|---|---|---|
| 0371632 | 8/1990 | European Pat. Off. . | |
| 584743 | 3/1994 | European Pat. Off. | 15/319 |
| 2336758 | 3/1974 | Germany . | |
| 2225933 | 6/1990 | United Kingdom . | |

*Primary Examiner*—Chris K. Moore

*Attorney, Agent, or Firm*—A. Burgess Lowe; Richardson B. Farley

[57] ABSTRACT

The disclosure describes a vacuum cleaner having a dirt sensor circuit usable with an audio detector. The circuit provides amplification of the audio signal, a pulse stretcher, sensitivity selection of a non linear characteristic and visual signal means to indicate high or low levels of dirt concentration.

8 Claims, 3 Drawing Sheets

VACUUM CLEANER WITH DIRT DETECTION

BACKGROUND OF THE INVENTION

1. Field of the Invention

This invention relates to a vacuum cleaner and, more specifically, to a vacuum cleaner having a dirt detection system.

2. Summary of the Prior Art

Both audio and photo electric dirt sensing are old and well known in the cleaner art. However, audio sensing is deemed preferable since the provision of sensitivity for both fine dirt, i.e., dust, and large particle dirt, i.e., sand, is more easily accommodated in an audio detecting arrangement. Moreover, there is no general accumulation of dirt on an audio sensor since it is not usually disposed in the dust stream so it cannot suffer a distortion or lack of response due to a fine coating of dust such as that to which a photo electric cell is subjected.

Since there is less distortion with an audio detector, the use of an audio sensing system needs utilization of a differing and improved electronic network for final dirt indication so that a more reliable sensing results, in total.

Accordingly, it is an object of the invention to provide an improved electronic dirt sensing circuitry.

It is a further object of the invention to provide an improved electronic dirt sensing circuit for an audio sensing system.

It is a still further object of the invention to provide a dirt sensing circuitry with an improved selectivity arrangement.

It is an additional object of the invention to provide an improved dirt sensing and dirt indicating arrangement utilizable and combined with a vacuum cleaner.

SUMMARY OF THE INVENTION

The invention comprehends the use of an audio dirt detection system in a vacuum cleaner to generally indicate to the user when the level of dirt being vacuumed by a vacuum cleaner has reached a diluted concentration sufficient to indicate an acceptable level of cleanliness being obtained in and on the floor covering undergoing cleaning.

The invention is carried out, e.g., in an upright cleaner by mounting a detector in the form of a microphone at the bend formed in a conveniently provided upper fill duct so as to detect the impingement of dirt, physically necessitated by the internal bend of this tube. This microphone is electrically connected to the dirt detection, circuitry and its battery which are lodged in a console cap of the hard bag section of an upright cleaner.

The dirt detecting circuitry includes this self same microphone and battery, with the battery connected across the power input of the circuitry and with one branch of this connection being connected to it by an on/off actuating switch in series with one terminal of the battery. The microphone is connected to the signal input of the dirt detecting circuitry.

Within the dirt detecting circuitry, the output of the microphone is fed to a two stage high pass filter amplifier. The filtered and amplified dirt pulses are then DC level shifted to trigger a monostable multivibrator where the monostable multivibrator acts a pulse stretcher to provide longer electrical pulses which are then integrated by the next portion of the electronic circuitry. This integrating section governs the selectivity of the dirt detecting circuit, with a single pole double throw switch placing a first or second portion of it in an activated condition so that a particular rate of integration is selected for the desired sensitivity. The system is completed by a pair of LEDS which change for dirt indication from green to red when the integrated pulse produces a voltage value equal to or above a predetermined set point. In addition an added resistor capacitor network provides an initialization portion of the dirt detecting circuitry to always insure an initial red indication by the red LED which turns on when power is first applied to the system.

BRIEF DESCRIPTION OF THE DRAWINGS

Reference now may be had to the accompanying Drawings for a better understanding of the invention, both as to its organization and function, with the illustration showing a preferred embodiment, but being only exemplary, and in which.

DETAILED DESCRIPTION OF THE INVENTION

Figure 1:
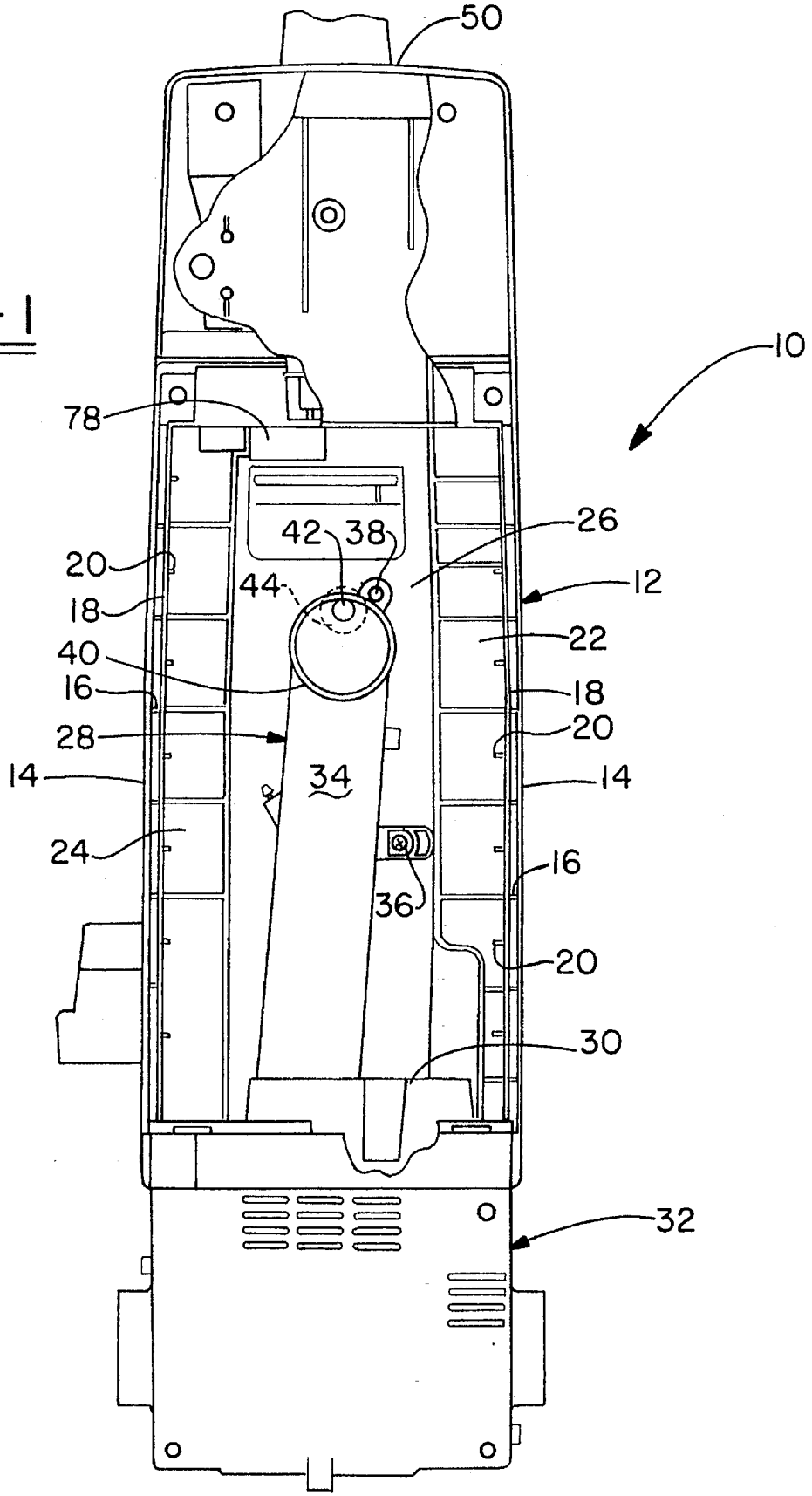
FIG. 1 is an elevational view of a cleaner hard bag housing of a vacuum cleaner with the hard bag cover removed and which mountingly incorporates the invention.

There is shown in FIG. 1 a hard bag housing 12 of a vacuum cleaner 10 which would normally cover and house a dirt collecting bag (not shown). The hard bag housing 12 is generally U-shaped in plan section and includes angled, outwardly vertically extending leg walls 14, 14 having a series of horizontally extending ribs 16, 16 that extend between and space the walls 14, 14 from inner generally parallel walls 18, 18. These dual walls serve to strengthen the hard bag housing 12. These inner walls 18, 18 also have a series of short ribs 20, 20 which are elongated inwardly to terminate at a pair of inwardly disposed ribbed semi-arched panel sections 22, 24 that are both offset inwardly into the internal volume of the hard bag housing 12 relative to a generally, centrally outwardly disposed portion 26 forming the central section of the bight of this housing's plan U-shape. This generally completes the description of the hard bag housing 12 which will be here given since it is exemplary only and may take many forms and merely serves a lodgment and a supporting means for the inventive dirt sensor circuitry.

An upper fill tube 28 is attached at its bottom duct portion 30 to an inner hollow telescoping member of similar shape (not shown) and integral with bottom portions of the bag housing 12. This connection forms a fluid tight communication between it and the motor-fan system (not shown) for the vacuum cleaner 10. This motor-fan system may be partially lodged at the bottom of hard bag housing 12 in an integral half cylindrical housing portion 32 provided for this purpose. Upper fill tube 28 is integrally extended above bottom duct portion 30 by an upper duct portion 34 of smaller rectangular cross-sectional shape than bottom duct portion 30. A pair of fastening screws 36, 38 attach the upper duct portion 34 of upper fill tube 28 to the hard bag housing 12.

Upper fill tube 28 includes a right angled bend 40 at its upper end to provide a tubular bag snout for easy connection to a paper bag (not shown) which is to be mounted conventionally within the confines of bag housing 12. At the outer surface of rear side 42 of the right angled bend 40, immediately outside the area of most dirt impingement, (caused by the sharp angle of flow change) is disposed a short, small, hollow cylindrical boss 44. This boss is closed on its inner side by the outer surface of rear side 42 of the upper fill tube 28 to protect its cavity 45 from direct dirt impingement and contact and is open at its outer side for reception of, ideally, a small cylindrical shaped microphone (not shown in FIG. 1).

Figure 2:
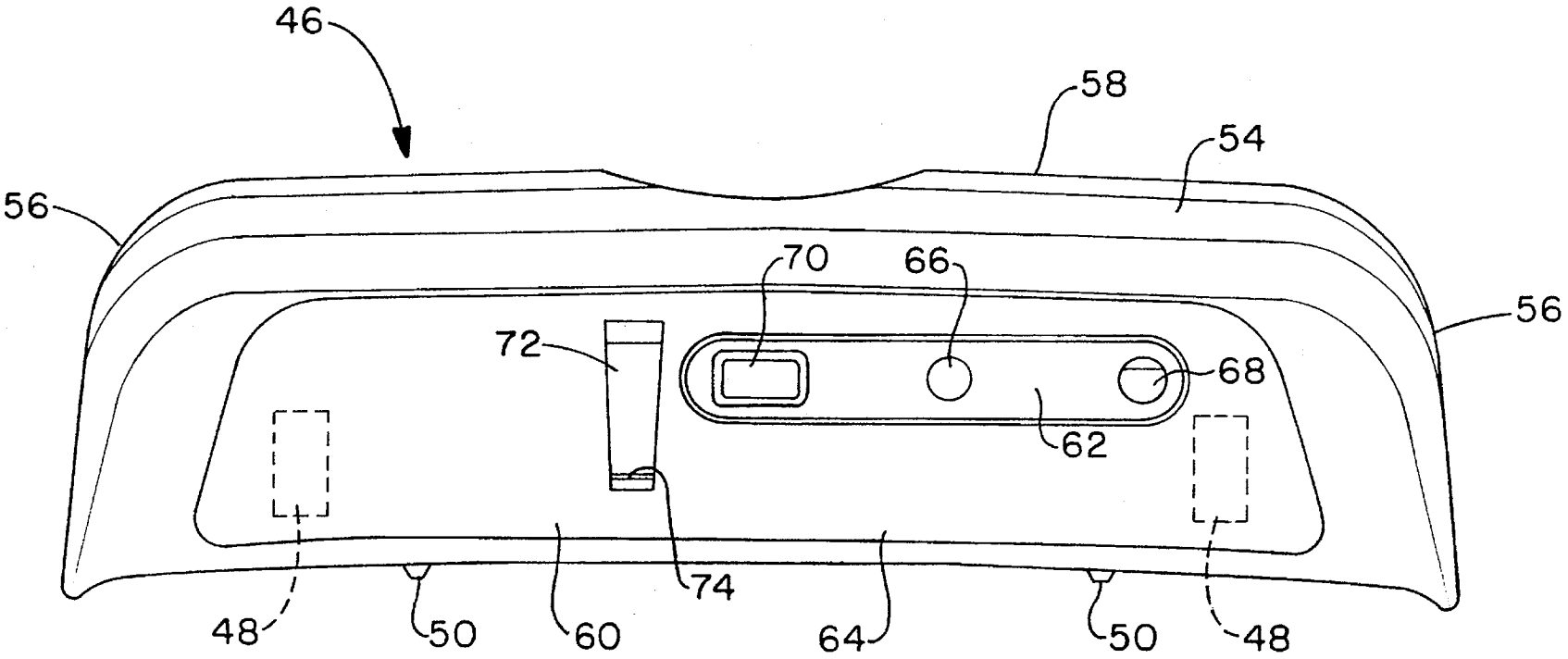
FIG. 2 is an elevational view of a housing cap for the cleaner hard bag and provided for encapsulation of the dirt sensing circuit.

Turning now to FIG. 2, a hollow housing cap 46 is shown which provides the console and housing for external display and internal mounting of the dirt sensing circuitry while a battery 78 is lodged in upper portion of the bag housing 12. Housing cap 46 conveniently may mount (not shown) to the top side of the bag housing by the use of internal screw mounting bosses 48, 48 screwingly attached (not shown) to hard bag housing 12 and locating pins 50, 50 which may be received in apertures (not shown) formed in a top wall 52 of hard bag housing 12.

Housing cap 46 has a curved linear top side 54, curvilinear ends walls 56, 56 and a rear wall 58. Housing cap 46 is completed in outline by a forward angled panel wall 60 that includes a raised bezel 62 that extends longitudinally horizontally along a front face 64 of forward panel wall 60. The raised bezel 62 mountingly includes a pair of red and green lenses 66, 68 and a raised mounting aperture 70 for a switch (to be later described). The housing cap 46 is generally completed by an access aperture 72 having at its bottom side an inwardly extending barbed hook 74 that may conveniently aid in maintaining (not shown) the combined electronic circuitry and battery pack of the dirt sensing arrangement, to be described later, securely on and stationary with the top of the bag housing 12.

This portion of the description completes the setting out of an exemplary general environment in which the inventive dirt sensing circuitry of the inventive instant Case is associated.

Figure 3:
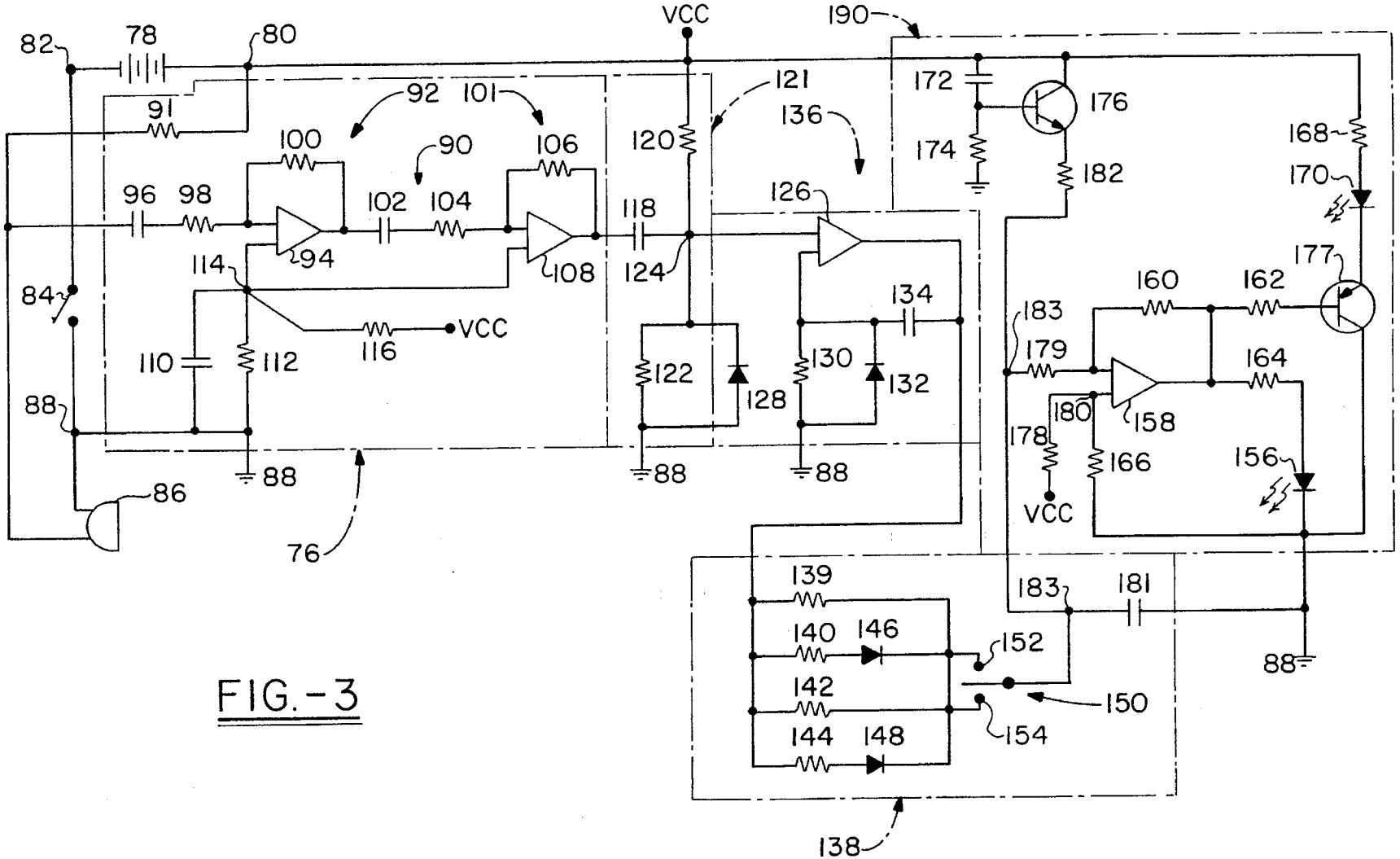
FIG. 3 is a circuit diagram of the audio dirt sensing circuit of the invention.

More specifically, a dirt sensing circuitry 76 is shown in FIG. 3. It includes the battery 78 attached across a pair of power input terminals 80, 82, with the negative input line of the battery 78 (terminal 82) having a switch 84, ideally a conventional rocker switch interposed in series relation with it. This switch is normally in the open position when the vacuum cleaner 10 is in an inoperative, switch off position and is closed when the cleaner is turned "on" and a handle mounted rod (not shown), e.g., somewhat similar to that shown in U.S. Pat. No. 5,226,527, issued Jul. 13, 1993 and owned by a common assignee is moved downwardly to turn on the main body nozzle mounted motor (not shown) for normal cleaner operation. This switch again opens when the switch rod (not shown) is reciprocated upwardly to turn the vacuum cleaner "off". A direct manually actuated switch could also be used or even a pressure operated switch activated by cleaner suction.

A conventional audio microphone 86 such as a microphone sold by Radio Shack Tandy Corporation®, such as, a conventional Electret Condenser Microphone, advertised as having an audiorange of 20 to 20,000 Hz. It is also connected across a pair of input terminals of the dirt sensing circuit 76 including the input terminal 80 and an input terminal 88. This microphone, as previously described, is mounted in hollow boss 44. A shunt also extends from input terminal 88 to negative input terminal 82.

The electrical signals produced by the microphone 86 by the audible signals occurring through cleaner motor noise, air movement through the upper fill tube and dirt impingement on the rear side 42 of upper fill tube 28 provide pulses, the first raw signals, to the remainder of the dirt sensing circuit 76. It has been found that this microphone by Frequency Spectra analysis provides a higher signal to noise ratio and is more effective in the 16,000 to 40,000 Hz range. Selecting this band of frequencies will enable the dirt sensing circuit 76 to detect most types of dirt. These pulses are fed to a two stage high pass filter amplifier 90. Amplifier 90 has a formed first stage 92 having an operational amplifier 94 (available commercially as a UG324 chip), a capacitor 96 and resistances 98, 100 and a second stage 101 consisting of a capacitor 102, resistance 104, 106 and a second amplifier 108 (UG324). This portion of the circuit amplifies its incoming signal since the capacitors and their associated resistance form a first impedance (Z1) and the other resistance in each stage forms a second impedance (Z2). Since capacitor reactance approaches zero at higher frequencies then only the higher frequency components are amplified. Each of these amplifier's gain is generally given as Vout/Vin=Z2/Z1. A bias resistor 91 is provided in the line extending from the terminal 80 for the microphone 86.

The dirt sensing circuit 76 also includes a capacitor 118 and a pair of resistors 120, 122 which forms a last stage of high pass filtering and level shifting to trigger a multivibrator 136 when signals above the background noise level are detected. These resistors are connected across the input lines 80 and 88 and have a juncture 124 of the connecting lines joined to the capacitor 118 which is also connected to the output of the second operational amplifier 108 of the chip (UG324). Capacitor 118 decouples the bias voltage established by the juncture 114. Resistors 120 and 122 use the voltage divider rule to establish a DC bias voltage for the third operational amplifier 126. The Juncture 124 is connected by a line to this third operational amplifier. The resistors 120, 122 and the capacitor 118 form, functionally, a passive high pass filter 121.

Operational amplifier 126 (the third chip—UG324), a first diode 128 (IN 914), a resistance 130 a second diode 132 (IN 914), and a capacitor 134, all of which are connected to the third operational amplifier 126 form a conventional multivibrator or pulse stretcher 136. These electrical components forming the multivibrator 136 function to take a narrow electrical pulse of approximately 25 microsecond wide from the juncture 124 and stretch it to approximately 8 millisecond wide to facilitate consistent integration. The generation of the 8 millisecond pulse is made possible at least in part by the first diode 128 which prevents the voltage at 124 from being driven below ground potential by more than 0.7 volts. The operations of such a conventional multivibrator is described, e.g., on page AN 74-10, *Linear Applications Handbook*, National Semiconductor Corporation, 1978.

This pulse is then fed to an integrating section 138 where the rate of integration "high" or "low" is selected by switch 150. With the switch in the "high" sensitivity mode, the integrator is formed by resistors 139, 140, diode 146, juncture 152 and capacitor 181. With the switch in the "low" sensitivity mode, the integrator is formed by resistors 142, 144, diode 148, juncture 154 and capacitor 181.

When switch 150 is in the high sensitivity mode, the dirt detection circuitry will require a minimum of three pulses, 8 millisecond wide, at a rate of 120 pulses per second to activate (turn on) the RED light emitting diode 156, giving a response time (time to turn on) of 0.025 seconds.

When switch 150 is in the low sensitivity mode, the dirt detection circuitry will require a minimum of six pulses, 8 millisecond wide, at a rate of 120 pulses per second to activate (turn on) the RED light emitting diode 156 giving a response time (time to turn on) of 0.056 seconds. This time is measured from the rising edge of the first 8 millisecond wide pulse (generated by the multivibrator 136) to the switching from the low to high of the schmitt trigger comparator output. This is all occasioned by the named components controlling the rate of integration in one of two manners as dictated by the switch 150 and, therefore, the response time of the system.

The dirt sensing circuit 76 is completed by an indicating section 190 including a fourth amplifier 158 (UG324) used as a schmitt trigger comparator. A review of such a comparator may be found on page AN 74-4 of the above cited publication. The upper trip point of the comparator is established by a voltage divider consisting of resistors 166 and 178 and has a juncture 180. These resistors are connected across the input lines 80 and 88 and has the juncture 180 of the connecting lines joined to the fourth operational amplifier 158 (fourth chip). Resistors 179 and 160 provides the hysteresis to establish the lower trip point.

The green LED is lit when the base of the transistor 177 is held at least 0.7 volts below the collector voltage; this happens when the output of operational amplifier 158 is in its low state. A review of a single such a comparator (schmitt trigger comparator) generally may be found on page AN 74-4 of the above cited publication.

When power is initially applied to the circuit 76, capacitor 172, resistors 182, 174 and transistor 176, allows a rapid flow of current to charge capacitor 181 thereby raising the voltage at juncture 183 above the upper threshold value established by resistors 166 and 178. With the upper threshold exceeded the output of comparator 158 will go to the high state turning on the red LED 156. The duration of this initialization sequence is determined by the setting of sensitivity switch 150. In the high mode the discharge path is through resistor 139 and amplifier 126. In the low mode the discharge path is through resistor 142 and amplifier 126.

When the system is in its normal mode "no dirt detected" the output of comparator 158 is low 0 volts holding the base of transistor 177 at 0.7 volts below its emitter enabling the greed led 170 to light. When dirt is detected by the circuit 76 and the integrated pulses produces a voltage at juncture 183 greater than the upper threshold established at juncture 180 the comparator 158 will go to the high state turning on the red LED 156 and at the same time raising the base voltage of transistor 177 above the emitter voltage thus turning off the green led 170.

It should be clear from the description offered that all the objects of the invention have been satisfied. It should also be clear that many changes could be made to the circuitry described which would still fall within its spirit and purview.

What is claimed is:

1. A vacuum cleaner having a dirt detecting circuit including:

a) an upper fill tube;

b) a microphone mounted outside said fill tube but closely adjacent thereto;

c) a dirt detecting circuit electrically connected to said microphone;

d) said dirt collecting circuit including a switchable integrator circuit portion for providing sensitivity selection for said dirt detector circuit.

2. The vacuum cleaner of claim 1 wherein: said dirt detecting circuit includes:

a) an amplifier filter circuit section;

b) a pulse stretcher circuit section; and c) said switchable integrator circuit portion also including a switch whereby the selectivity of the said dirt detecting circuit may be altered.

3. The dirt detecting circuit of claim 1 wherein:

a) said integrator circuit includes at least one comparator circuit section.

4. The dirt detecting circuit of claim 3 wherein:

a) said comparator circuit section is a schmitt trigger comparator.

5. The dirt detecting circuit of claim 1 wherein:

a) said integrator circuit includes more than one comparator circuit section.

6. The dirt detecting circuit of claim 5 wherein:

a) said switch switches between at least two of said comparator circuit sections.

7. The dirt detecting circuit of claim 1 wherein:

a) said integrator circuit section provides at least a pair of time variables for said dirt detecting circuit.

8. A vacuum cleaner according to claim 7 wherein:

a) said dirt detector circuit is mounted in a console top cap for said vacuum cleaner.

* * * * *